US005359754A

United States Patent [19]

Kondo et al.

[11] Patent Number: 5,359,754

[45] Date of Patent: Nov. 1, 1994

[54] TOP END STOP FOR CONCEALED SLIDE FASTENER

[75] Inventors: Naoki Kondo; Yoshinori Fujisaki, both of Toyama, Japan

[73] Assignee: Yoshida Kogyo K.K., Tokyo, Japan

[21] Appl. No.: 89,553

[22] Filed: Jul. 12, 1993

[30] Foreign Application Priority Data

Jul. 16, 1992 [JP] Japan ..... 4-049971[U]

[51] Int. Cl.[5] ..... A44B 19/00

[52] U.S. Cl. ..... 24/436; 24/433

[58] Field of Search ..... 24/436, 435, 433, 388, 24/389

[56] References Cited

U.S. PATENT DOCUMENTS

| | | | |
|---|---|---|---|
| 3,775,815 | 12/1973 | Johnston et al. | 24/436 |
| 3,818,575 | 6/1974 | Johnston et al. . | |
| 3,972,095 | 8/1976 | Kandou | 24/436 |
| 4,045,845 | 9/1977 | Kando | 24/436 |
| 4,878,275 | 11/1989 | Kazui et al. | 24/436 |

FOREIGN PATENT DOCUMENTS

| | | | |
|---|---|---|---|
| 0237068 | 9/1987 | European Pat. Off. . | |
| 2305058 | 8/1974 | Germany . | |
| 51-4819 | 2/1976 | Japan . | |
| 62-148116 | 9/1987 | Japan . | |
| 0510170 | 2/1955 | United Kingdom | 24/436 |

*Primary Examiner*—Victor N. Sakran
*Attorney, Agent, or Firm*—Hill, Steadman & Simpson

[57] ABSTRACT

A concealed slide fastener top and stop is formed by wrapping around a edge of a fastener tape with a U-shaped piece of synthetic resin and fusing the U-shaped pieces. The U-shaped piece is fused at its open ends through the fastener tape. The fused-through portion is shifted inwardly from a tape folded-in part, to which a row of fastener elements is attached. The fused-through portion is at an angle different from that of the fastener elements.

3 Claims, 5 Drawing Sheets

TOP END STOP FOR CONCEALED SLIDE FASTENER

BACKGROUND OF THE INVENTION 1. Field of the Invention

The present invention relates to a top end stop structure for a concealed slide fastener with zigzag or coil shaped filamentary fastener elements made of synthetic resin.

2. Description of the Related Art

One kind of top end stop structure for a concealed slide fastener is known (Japanese Utility Model Publication No. Sho 51-4819), in which a pair of bow-shaped pieces of synthetic resin are each fused across the legs and connecting portions of several of the fastener elements onto the upper end of the underside of the slide fastener. These synthetic resin pieces bow outwards so as to protrude in the same direction as the connecting portions away from the coupling heads of the fastener elements.

Another kind of top end stop structure for a concealed slide fastener is known (Japanese Patent Publication No. Sho 52-6656), in which a pair of top end stops are each formed from a lump of fusible material. The outer surface of this lump then coincides with the peak in the folded-in part at a respective one of successive space portions of the fastener chain. The inner surface then goes in between the tape and the edge of the folded-in part and extends beyond the outer edge of the folded-in part. At the other end there is a bow-shaped lip, the shape of which corresponds to that of the inner edge of the folded-in part of the tape.

A further top end stop structure for a slide fastener is known (Japanese Utility Model Laid-Open Publication No. Sho 62-148116), in which a flat piece of thermoplastic synthetic resin is bent into a U-shaped top end stop. This is then applied to the top end of each of opposite rows of fastener elements and is then fused in such a manner that its open ends fuse together through the fastener tape.

The concealed slide fastener top end stop described in the first publication is only fused onto one side of the fastener tape. This means that after long periods of use there is a strong possibility that it will fall away from that surface. Also, since the fastener elements and the fastener tape are parallel with each other, it is very difficult to insert such concealed slide fastener into the sewing machine foot guide.

Further, the concealed slide fastener described in the second publication is formed with a bow-shaped lip, the shape of which corresponds to that of the inner edge of the folded-in part of the fastener tape. Therefore, if its supporting area with respect to the fastener tape is increased , the angle between the supporting area and the tape has to be kept small, thus making the insertion of the concealed slide fastener into the sewing machine foot guide very difficult. Also, the top end stop is of the type inserted into the flanged part of the slider. This means that the pair of fastener tapes diverge at the openable side so that the slide fastener has an unpleasant external appearance.

The slide fastener top end stop described in the third publication is just the usual kind of top end stop and is not actually a top end stop for a concealed-type slide fastener. It therefore, cannot be expected to have the kind of construction like the one for the embodiment for this application where the U-shaped stopper part is held at a fixed angle with respect to the fastener elements. Also, the curved head of the U-shaped top end stop does not come into contact with the slider flange which makes the stopping function of the top end stop highly questionable.

SUMMARY OF THE INVENTION

With the foregoing problems in view, an object of this invention is to provide a top end stop for a concealed slide fastener which does not come away from the fastener tape even after long periods of use, and which can be easily inserted into the sewing machine foot guide so that the sewing efficiency can be increased. Also, the top end stop will come into contact with the slider guide flange in response to the opening and closing operation of the slider, and thus serves to put the remaining edge portion of the fastener tape inwardly for compensation so as the concealed slide fastener can appear attractive when viewed from the outside.

According to the invention, there is provided a concealed slide fastener top end stop formed by wrapping around an edge of a fastener tape with a U-shaped piece of synthetic resin and fusing the U-shaped piece, wherein the U-shaped piece is fused at its open ends through the fastener tape, such fused-through portion being shifted inwardly from a tape folded-in part, to which a row of fastener elements is attached, and being at an angle different from that of the fastener elements.

Further, the fused portion of the U-shaped piece projects obliquely outwardly from connecting portions of the fastener elements, the top end stop being formed so as to be engageable with a guide flange of a slider.

By constructing the concealed slide fastener top end stop of this invention as described above, when the slider is slid along the fastener chain in the closing direction, its guide flange comes into contact with the side of the top end stop, i.e., the upper per stopper. Moreover, the base side of the top end stop, i.e., the fused-through portion comes into contact with the central guide column of the slider so that the slider is stopped. At this times both of the outside edges are applied with pressure in the closing direction and the folding-side of the top end stop is, therefore urged into the slider and the remaining edge surface of the fastener can be used for compensation in the direction.

Additional features and advantages of the present invention are described in, and will be apparent from, the detailed description of the presently preferred embodiments as well as the drawings.

BRIEF DESCRIPTION OF THE DRAWINGS

FIG. 6 is a cross-sectional view taken generally along line II—II of. FIG. 5.

DETAILED DESCRIPTION OF THE PRESENTLY PREFERRED EMBODIMENTS

The following is a detailed description, with reference to the accompanying drawings, of embodiments of a concealed slide fastener top end stop according to this invention.

Figure 1:
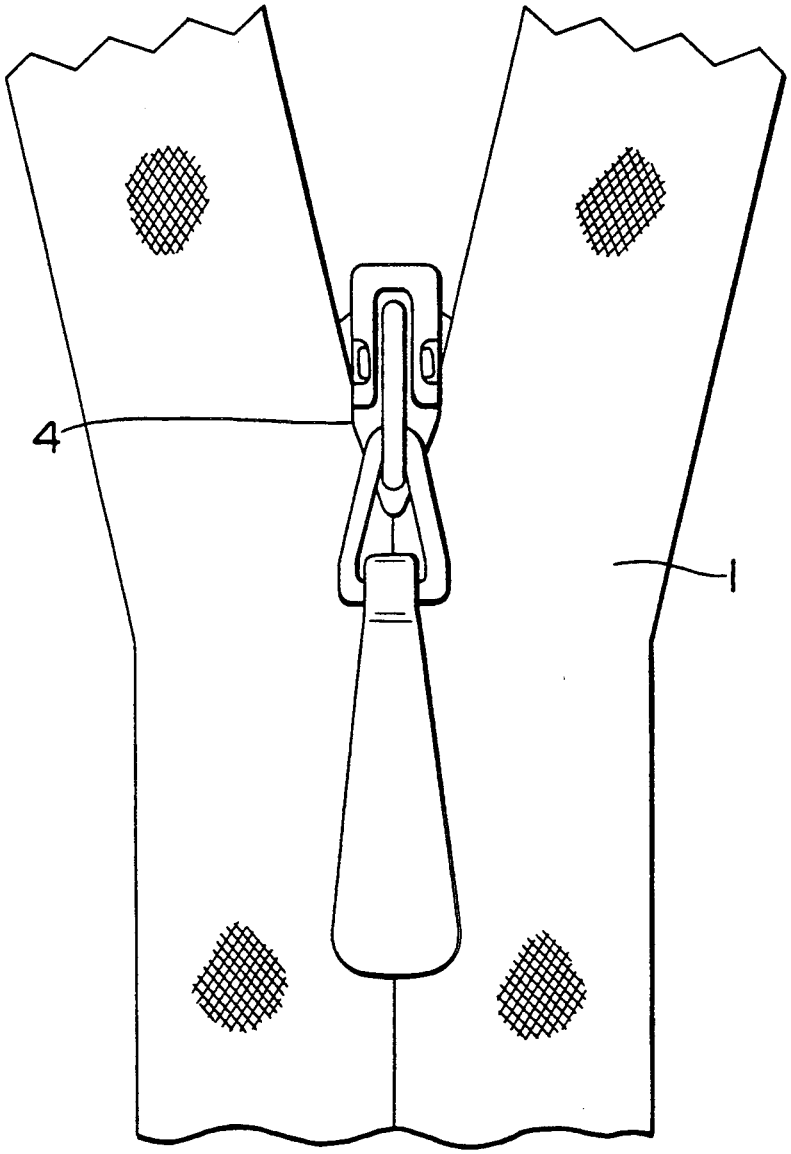
FIG. 1 is a fragmentary plan view of a concealed slide fastener.
Figure 2:
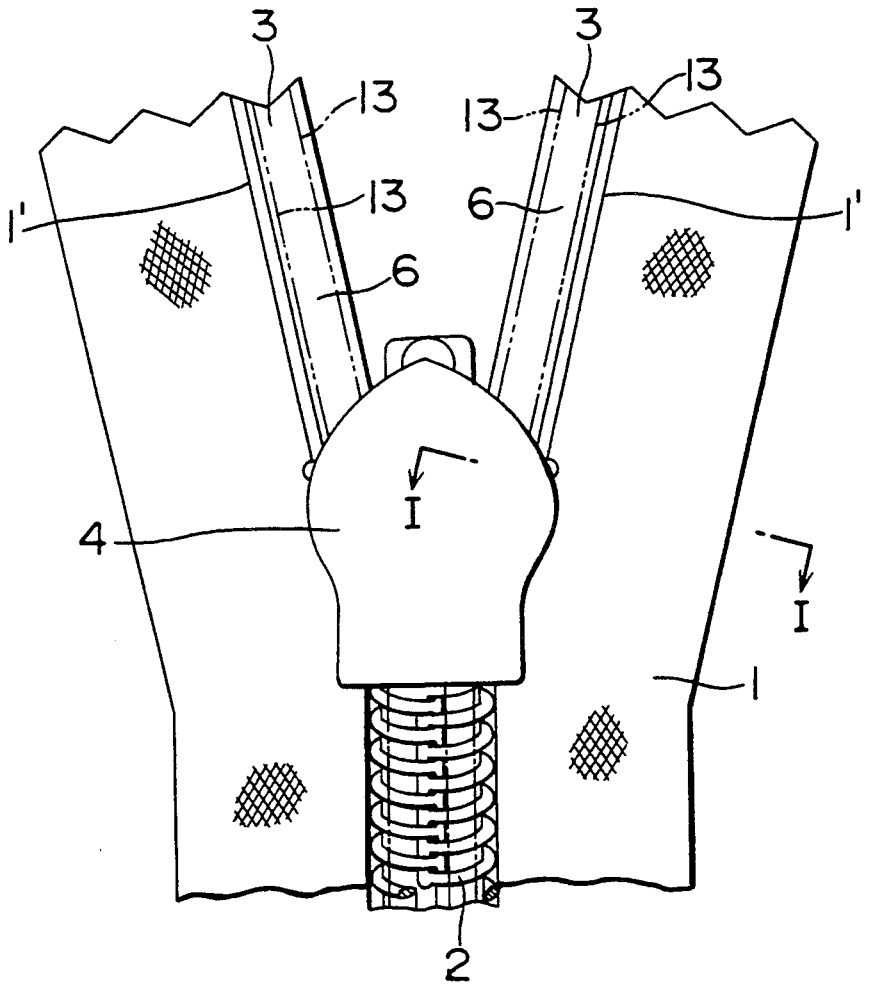
FIG. 2 is a rear view of the concealed slide fastener of FIG. 1.
Figure 3:
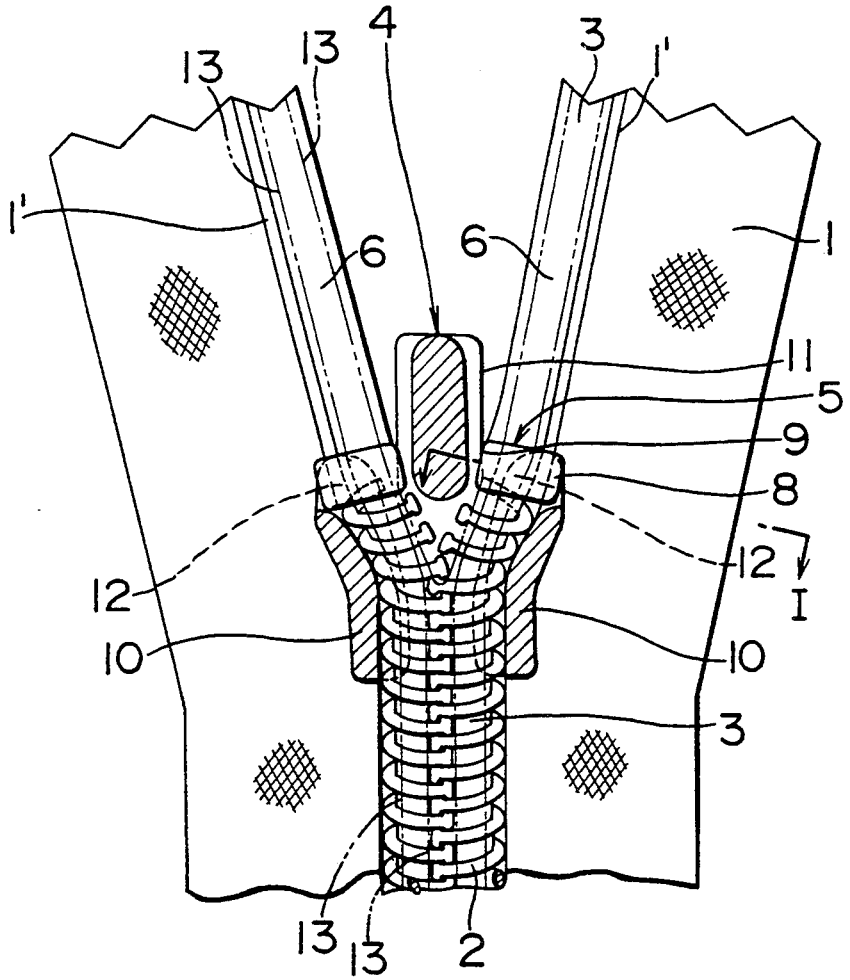
FIG. 3 is a fragmentary rear view of the concealed slide fastener of FIG. 2, showing a slider in cross section.

In this concealed slide fastener, as shown in FIG. 3, the inner edge of each of confronting fastener tapes is folded around to form a fold 1' to which, for example, fastener elements 2 in the form of coiled or zigzag-shaped filaments are sewn. In the case of coiled fastener elements 2, core threads 3 are customarily sewn in between the fastener elements 2. A slider 4 is threaded onto this fastener chain as shown in FIGS. 1 and 2, in such a way that when the fastener chain is closed, the fastener chain elements 2 are not visible when viewed from the front side, as shown in FIG. 1.

This embodiment is for a top end stop 8 which will prevent a slider from being removed from a concealed slide fastener. The fold 1' is formed along the inner edge of the fastener tape 1. A U-shaped piece 5 of thermoplastic synthetic resin, such as polyamide, is then wrapped around the inner edge of a part of the fold 1' which is known as a space 6 free of any fastener elements 2 attached. In doing this, a leg portion 1 of a fastener element 2 and part of a connecting portion c are sandwiched between the U-shaped piece 5. The U-shaped piece 5 is then fused to the fastener tape 1 while it is in contact with this fastener tape 1, with the folding-side end portion of the U-shaped piece 5 projecting from the connecting portion c of the fastener element 2 to an extent A. Thus, a top end stop 8 is formed as a slider stopper.

Figure 6:
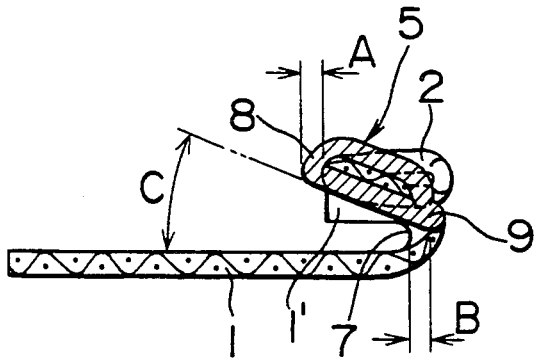

A fused-through portion 9 is formed when the open-side ends of the U-shaped stopper part 5, i.e. the ends which are fused to the fastener tape 1 next to the coupling heads h of the fastener elements 2, actually fuse through the fastener tape 1 and fuse with each other. The fused-through portion 9 is shifted inwardly by the portion B of the folded-in part 7 which is made in the fastener tape 1 at the point in which the fastener element 2 is attached. The result of this is shown in FIG. 6 and is as follows. The fastener element 2 is installed parallel to the fastener tape 1. On the other hand, when the U-shaped piece 5 is installed, it is held at a fixed angle with respect to the fastener tape 1, and therefore ends up being installed at a fixed angle different from that of the fastener element 2 with respect to the fastener tape 1.

Figure 4:
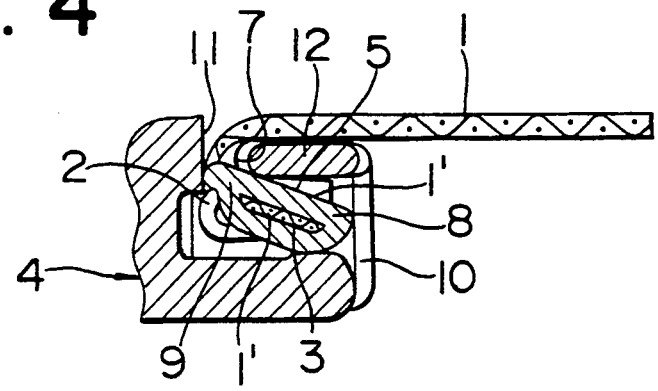
FIG. 4 is a cross-sectional view taken generally along line I—I of FIGS. 2 and 3.
Figure 5:
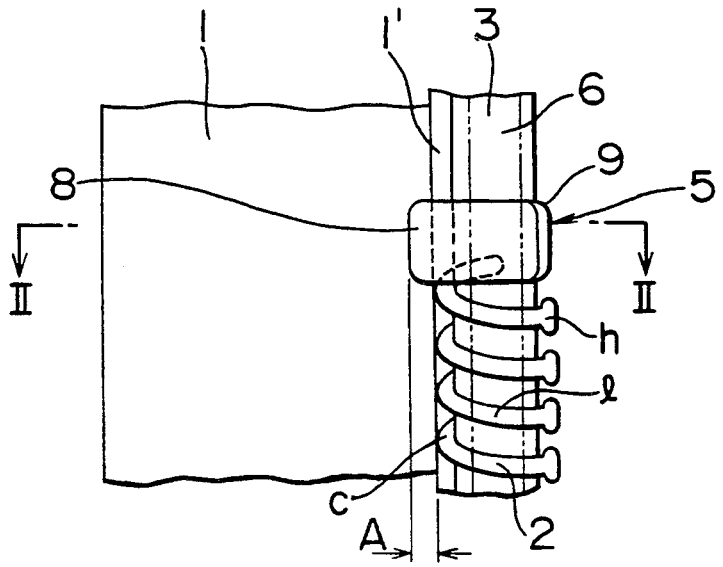
FIG. 5 is a plan view of a top end stop of the concealed slide fastener.

By using this kind of construction for the top end stop 8, as is shown in FIGS. 3 and 4, when the slider 4 is moved in the closing direction, the front ends of its guide flanges 10 will come into contact with the top end stops 8, and their corresponding fused-through portions 9 will come into contact with a central guide column 11 of the slider 4, and the sliding motion of the slider 4 will come to a halt.

Figure 7:
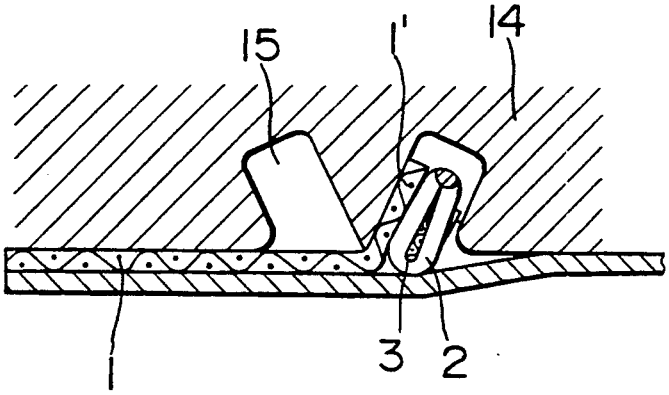
FIG. 7 is a cross-sectional view showing the manner in which a sewing machine foot guide is used.

In FIGS. 3 and 4, reference numeral 12 designates an upper wing which joins onto the guide flange 10 of the slider 4, and the dash-and-two-dot line indicates the sewn portion where the fastener elements 2 are sewn with the core threads 3. Also, in FIG. 7, reference numeral 14 designates the sewing machine foot guide which is used while the concealed slide fastener is being sewn to items such as clothing; and 15 designates a guide channel into which the fastener element 2 is inserted so that the fold 1' in the fastener tape 1 is held up during the sewing process.

The adoption of the construction described above as the concealed slide fastener top end stop in this embodiment has the following results.

A U-shaped piece 5 is wrapped around an edge of a fastener tape 1 and is fused to this tape 1 in such a manner that the open ends of the U-shaped piece 5 actually fuse through the fastener tape 1. The fused-through portion 9 is shifted within the portion B of the folded-in part 7 which is made in the fastener tape 1 at the portion in which the fastener element 2 is installed, so that it is at a fixed angle to the fastener element 2. So, for example, the fastener element 2 is parallel to the fastener tape 1, and the top end stop 8 is then formed at a fixed angle C to the fastener tape 1. In this way, there is no fear of the top end stop 8 coming away from the fastener tape 1 even after long periods of use. Also, the front end of the top end stop 8 is raised up due to its being at an angle C to the fastener tape 1 and the fastener element 2. The sewing efficiency can therefore be improved as the fastener element 2 can be inserted into the guide channel 15 in the sewing machine foot guide 14 much more easily during the sewing process.

An end of the fused U-shaped piece 5 is connected on a slant to the fastener element 2, with a projecting portion extending a distance A, thus forming a top end stop 8 with which the guide flange 10 of the slider 4 comes into contact. When the slider 4 is then closed, the remaining edge portion of the fastener tape 1 will be put inwardly for compensation, thus giving an attractive and neat finish to the openings in products which are made using this kind of concealed slide fasteners.

It should be understood that various changes and modifications to the presently preferred embodiments described herein will be apparent to those skilled in the art. Such changes and modifications can be made without departing from the spirit and scope of the present invention and without diminishing its attendant advantages. It is, therefore, intended that such changes and modifications be covered by the appended claims.

What is claimed is:

1. A concealed slide fastener top end stop formed by wrapping around an edge of a fastener tape, said end stop comprising:

a U-shaped piece of synthetic resin wherein said U-shaped piece of fused at its open ends through the fastener tape, such fused-through portion being shifted inwardly from a folded-in part of the fastener tape to which a row of fastener elements is attached wherein the folded-in part with the fused-through portion opens such that an end of the U-shaped piece opposite the fused-through portion is raised at an angle.

2. The concealed slide fastener top end stop according to claim 1 wherein said fused-through portion of said U-shaped piece is at an angle different from that of the fastened elements.

3. The concealed slide fasteners top end stop according to claim 1 wherein the fused-through portion of said U-shaped piece projects obliquely outwardly from connecting portions of the fastener elements, said top end stop being formed so as to be engageable with a guide flange of a slider.

* * * * *

UNITED STATES PATENT AND TRADEMARK OFFICE

CERTIFICATE OF CORRECTION

PATENT NO. : 5,359,754

DATED : November 1, 1994

INVENTOR(S) : Naoki Kondo; Yoshinori Fujisaki

It is certified that error appears in the above-indentified patent and that said Letters Patent is hereby corrected as shown below:

In Column 4, Line 59: in Claim 2 "fastened" should be --fastener--.

Signed and Sealed this

Twenty-eighth Day of May, 1996

*Attest:*

Bruce Lehman

BRUCE LEHMAN

*Attesting Officer*

*Commissioner of Patents and Trademarks*